United States Patent [19]

Bolton et al.

[11] Patent Number: 4,607,499

[45] Date of Patent: Aug. 26, 1986

[54] METHOD AND APPARATUS FOR ASSEMBLY OF A ROOM AIR CONDITIONER HOUSING

[75] Inventors: Theodore S. Bolton, Liverpool; Robert J. Whitwell, Nedrow, both of N.Y., 99

[73] Assignee: Carrier Corporation, Syracuse, N.Y.

[21] Appl. No.: 778,113

[22] Filed: Sep. 20, 1985

[51] Int. Cl.[4] ..... F25D 23/12

[52] U.S. Cl. ..... 62/262; 62/297; 312/101

[58] Field of Search ..... 62/262, 263, 297; 312/101, 236

[56] References Cited

U.S. PATENT DOCUMENTS

| | | | |
|---|---|---|---|
| 3,665,727 | 5/1972 | Mather | 62/262 |
| 3,680,328 | 8/1972 | McCarty | 62/262 |
| 3,766,749 | 10/1973 | Liversay | 62/262 |
| 4,555,983 | 12/1985 | Bolton et al. | 312/101 X |

*Primary Examiner*—Lloyd L. King

*Attorney, Agent, or Firm*—Dana F. Bigelow

[57] ABSTRACT

An air conditioner housing is formed of upper and lower polymeric shells having flanges on the outer side of their abutting rims. Together, the upper and lower flanges form a dovetail for slideably receiving an aluminum channel member thereover to secure the two elements together and provide for load sharing therebetween.

8 Claims, 4 Drawing Figures

METHOD AND APPARATUS FOR ASSEMBLY OF A ROOM AIR CONDITIONER HOUSING

BACKGROUND OF THE INVENTION

This invention relates generally to air conditioning systems and, more particularly to a method and apparatus for securing separate housing elements to form a housing for encasing internal components of a room air conditioner system.

Traditionally, a room air conditioner system has been constructed with a base pan fabricated from sheet metal and having the various internal components attached thereto. One or more covers or so-called "wrappers" are then placed over the installed components and secured to the base pan structure by conventional fasteners such as screws or the like. Considerable time was therefore required for fastening the housing elements together, not only during the initial assembly process, but also later when it was necessary to remove the cover for maintenance or repair services.

The use of plastic materials has more recently become common for the replacement of sheet metal materials in air conditioning housing structures. One approach has been to provide a base pan fabricated from a sheet metal material, attaching various plastic elements thereto with screws or the like, and then covering the entire assembly with one or more plastic housing elements. Such a structure is shown in U.S. Pat. No. 3,766,749 issued to Livesay on Oct. 23, 1973.

Another approach in the use of plastics is now being made by a commercially available unit wherein the upwardly extending intermediate partition is integrally formed with the base pan from a sheet molding compound (SMC), polyester material. The internal components are mounted to the base pan, or to the partition, and front and rear covers made from a similar polyester material are installed to complete the housing.

Whether a single or multiple cover elements are used, it is necessary to secure those elements together or to secure them to a supporting structure such as the base pan or the partition. Generally, screws are used for this purpose. However, there are various other mechanical fastening devices that have been employed for this purpose. All of them involve considerable time and effort, both in the initial assembly process and later, when it is necessary to remove the cover elements for maintenance and/or repair services.

Another design for a polymeric housing structure is that shown in application Ser. No. 778114 filed concurrently with the present application and assigned to the common assignee. Here, it was desired to secure an upper casing member to a lower casing member into which the internal components were installed. With such an arrangement it was desirable to transfer a portion of a load from the bottom casing member to the top casing member. In doing so, it was necessary to keep in mind other, more conventional, requirements such as simplicity, aesthetics, and the ability to quickly and easily assemble and disassemble the structure.

It is, therefore, the object of the present invention to provide an improved method to secure together housing elements of an air conditioner unit to provide an aesthetically pleasing and secure housing structure.

Another object of the present invention is the provision in a two-piece air conditioner housing structure for load sharing between the upper and lower casing elements.

Yet another object of the present invention is the provision for quickly and easily attaching a pair of mating casing structures to provide a housing for a room air conditioner.

Still another object of the present invention is the provision for an air conditioner housing attachment structure which is economical to manufacture and extremely functional in use.

These objects and other features and advantages become more readily apparent upon reference to the following description when taken in conjunction with the appended drawings.

SUMMARY OF THE INVENTION

Briefly, in accordance with one aspect of the invention, both the upper and the lower housing elements are provided with an outwardly extending flange on their abutting rims, the flange on the lower housing element being flared downwardly and that on the upper housing element being flared upwardly such that when the upper housing element is placed over the lower housing element with their rims in abutting relationship, the two flanges form a dovetail. A conforming channel element is then installed over the dovetail to securely fasten the upper and lower housing elements together. Load sharing can thus occur between the two elements along the entire length of the channel member. Further, the channel member can be formed of an aesthetically pleasing material and shape such that it is decorative in nature. Temporary removal of the housing structure for maintenance and repair services can subsequently be easily accomplished by sliding the channel member off the dovetail structure.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

Referring now to FIG. 1, the invention is shown generally at 10 as applied to a room air conditioner 11 comprised of upper and lower elements 12 and 13, respectively. The upper element 12 and the lower element 13 are fastened together by the securing apparatus shown generally at 14 in accordance with the present invention.

Figure 4:
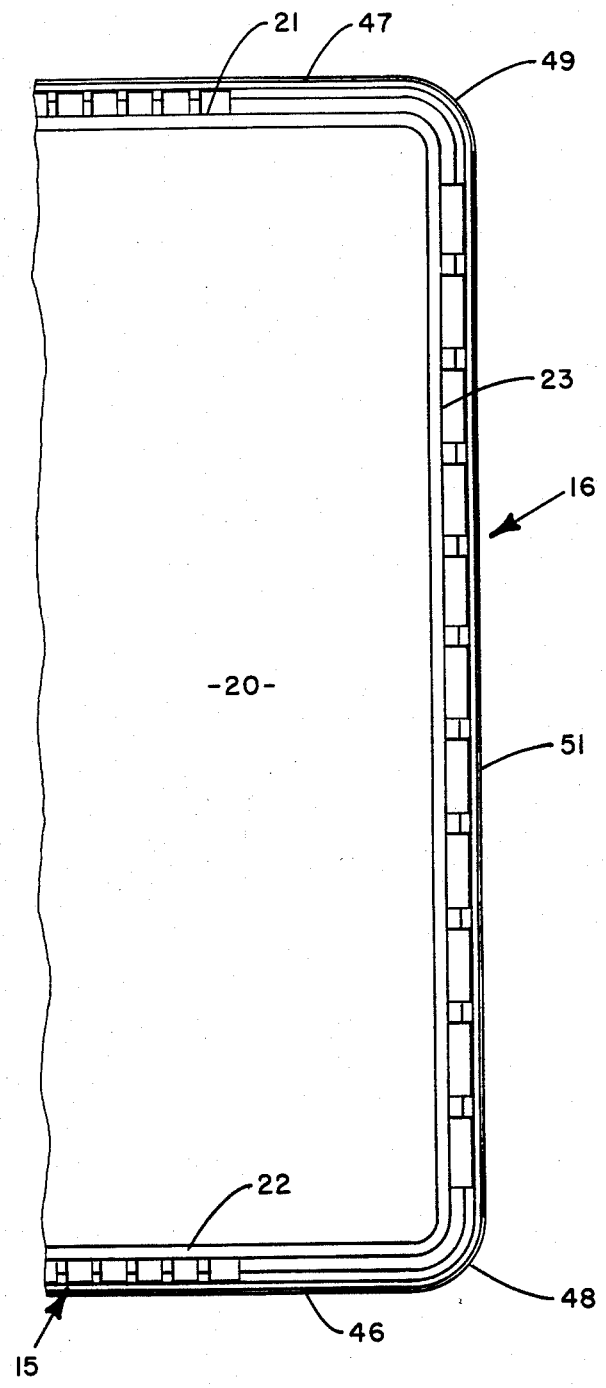
FIG. 4 is a top view thereof.

Although the housing 11 is shown without its front cover and without any of its internal components, it should be understood that these components would be including as part of the system having outdoor and indoor sections which operate in a conventional manner to provide conditioned air to an internal space. Thus, during normal operation, the outdoor air flows into the air intake openings 15, through an outdoor coil and out the discharge openings 16 of the rear side (FIG. 4). The indoor air passes into the return air opening 17, through the indoor heat exchanger, and out the air discharge opening 18. Normally, a front cover with an incorporated grille structure (not shown) would be placed over the front side 19 of the housing 11.

Figure 1:
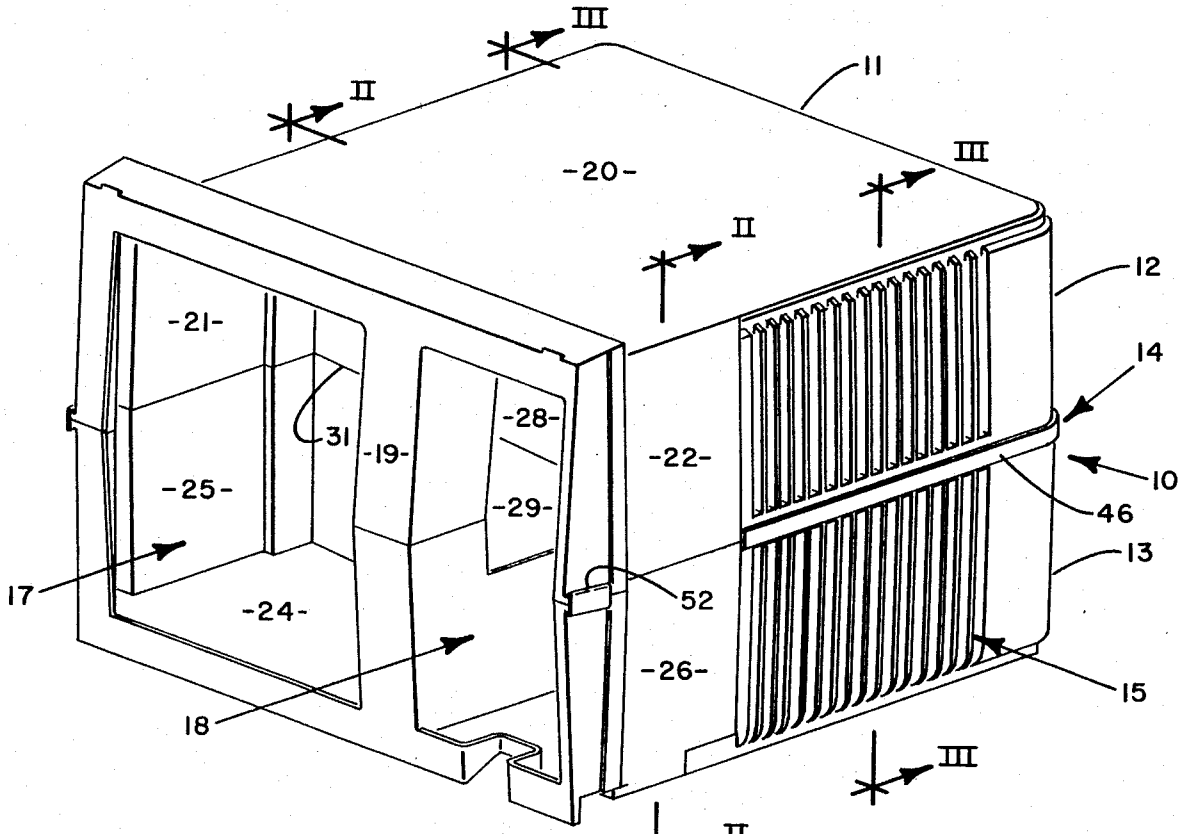
FIG. 1 is a perspective view of a room air conditioner housing in accordance with the preferred embodiment of the invention.
Figure 2:
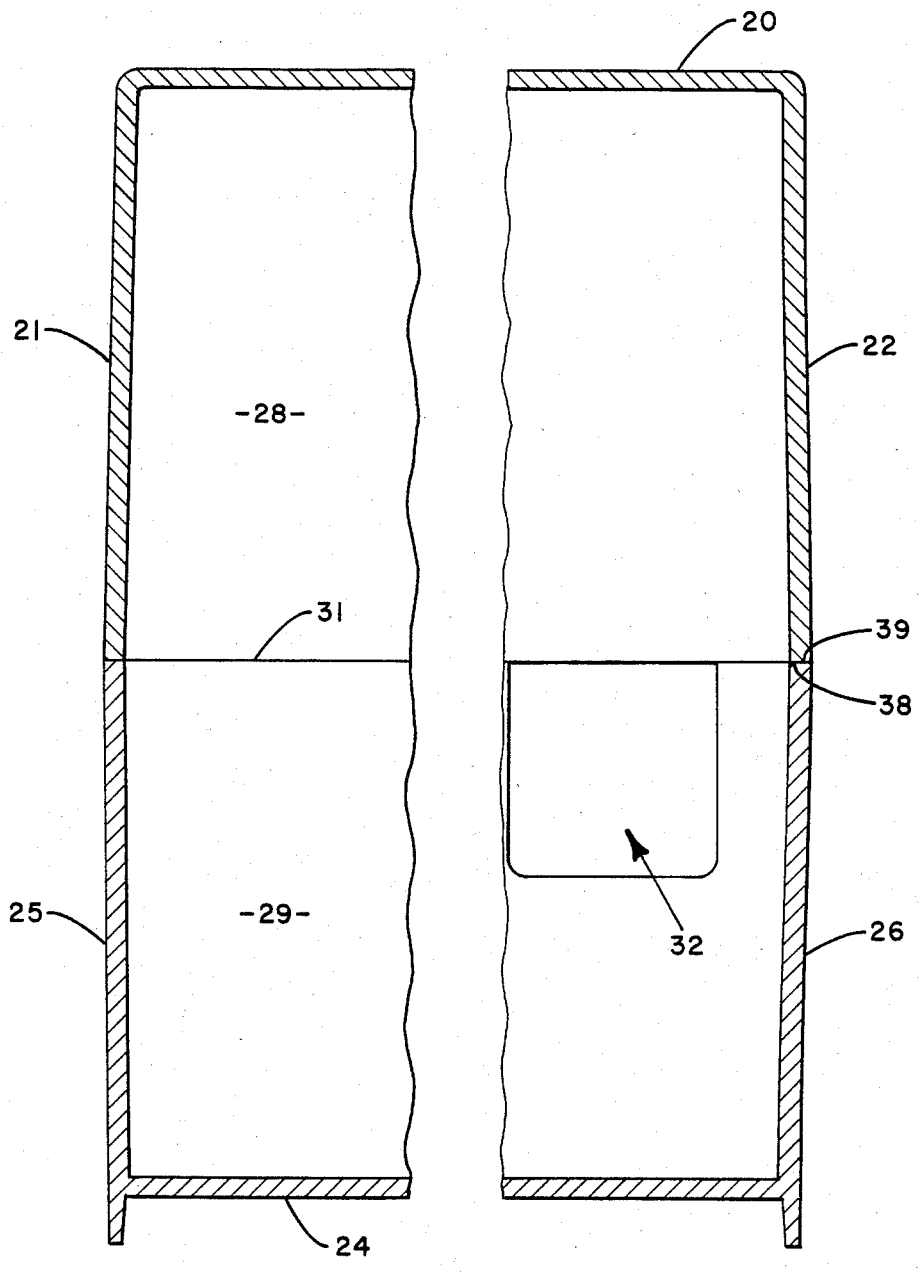
FIG. 2 is a partial sectional view thereof as seen along lines 2—2 of FIG. 1.
Figure 3:
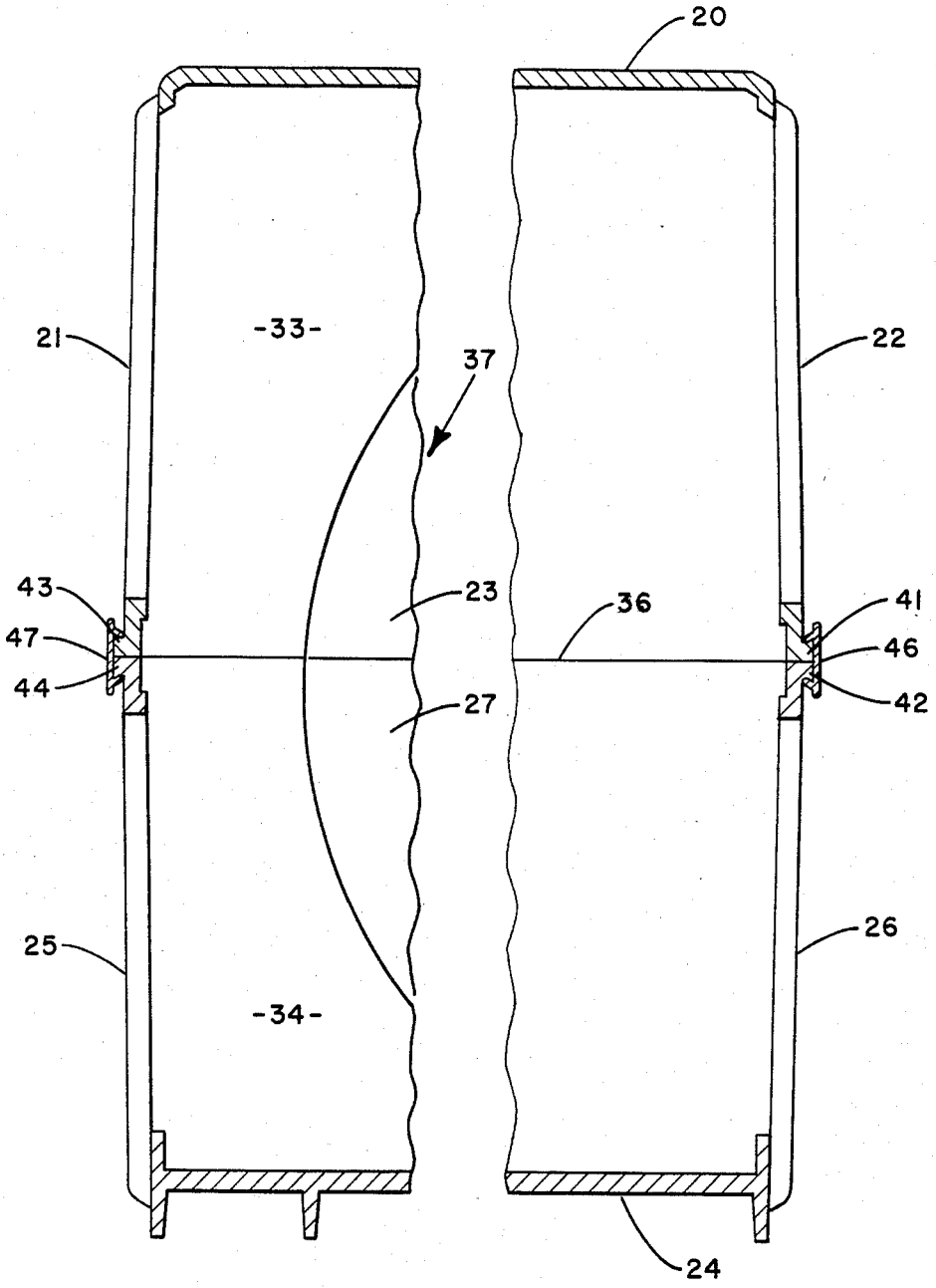
FIG. 3 is a partial sectional view thereof as seen along lines 3—3 thereof.

Referring now to the upper element 12 and the lower element 13 in more detail as shown in FIGS. 1–4, the upper element 12 includes an upper element top wall 20, upper element side walls 21 and 22, and an upper element rear wall 23 (See FIG. 3). Similarly, the lower element 13 includes a lower element bottom wall 24, lower element side walls 25 and 26, and the lower element rear wall 27.

On the inner side of the housing 11 is a partition defining the boundary between the outdoor section and the indoor section, the partition comprising an upper element partition wall 28 and a lower element partition wall 29. Their edges are disposed in abutting relationship to form a joint 31 as shown. A rectangular opening 32 is provided in the lower element partition wall 29 to allow for the passing for refrigerant piping therethrough.

Also within the housing 11 is a condenser fan shroud upper element 33 and condenser fan shroud lower element 34 with their edges abutting at a joint 36 in the intermediate plane (See FIG. 3). The condenser fan shroud has a circular opening 37 formed therein for receiving the fan in concentric relationship therewith. Thus, the condenser fan shroud forms the boundary between the high and low pressure (i.e. air pressure) sides of the outdoor section.

Referring now to the interface structure between the housing upper element 12 and the housing lower element 13, it will be seen in FIG. 2 that the rim 38 of the upper element engages the rim 39 of the lower element along each side of the housing. This is also true at the rear side thereof. It will be seen by reference to FIGS. 1 and 2 that there is a short span wherein the joining of the upper element 12 and the lower element 13 merely forms a continuous wall with a slight outward curve at the joint. However, the remaining portion of the sides has structure provided for interconnecting the upper and lower elements 12 and 13. This structure, as shown in FIG. 3, includes the flanges 41 and 42 formed at the respective upper element rim 38 and lower element rim 39 on the one side, and flanges 43 and 44 formed on the other side of the housing. Thus, when the upper element 12 is installed over the lower element 13 with their respective rims 38 and 39 in engagement, the flanges 41 and 42 collectively form a dovetail on the one side of the housing and the flanges 43 and 44 form a dovetail on the other side of the housing. The elements are then connected by way of a U-shaped channel elements whose internal cross-sectional profile conforms to the external cross-sectional profile of the dovetails. The two side channel elements are shown in their installed positions at 46 and 47, respectively, in FIG. 3. The channel elements are preferably fabricated from a relatively strong material which allows for the transfer of a portion of the load from the housing lower element 13 to the housing upper element 12. They are also preferably decorative in form and texture since they are clearly visible on the outer surface of the system. Extruded aluminum is one material which has been found suitable for this purpose.

Referring to FIGS. 1 and 4, it will be seen that the channel elements 46 and 47 are linear along most of their length but have arcuate, 90° sections 48 and 49, respectively at their ends. These arcuate portions wrap around, in conforming relationship with, the rounded corners of the housing such that their ends are in adjoining relationship with the ends of a linear channel element 51 on the rear side of the housing.

The channel element 51 is identical in cross-section to channel elements 46 and 47 and is designed to fit over a dovetail structure at the rear side of the housing in the same manner as shown for the sides in FIG. 3. Similarly, there are provided near the front of the housing, on each side thereof, short spans of channel elements 52 and 53 which are adapted to slide over a dovetail structure on the housing to thereby secure the two housing elements together and provide for load sharing therebetween.

Having defined the structure, the method of assembly will now be briefly described. The lower element 13 is first placed with its open side up such that various internal components can be installed therein. The upper element 12 is then placed in position such that its rim abuts that of the lower element 13. The rear channel element 51 can then be slid on to its associated dovetail structure from either end thereof. The side channel elements 46 and 47 can then be slid on from the rear side until their arcuate portions 48 and 49 are tightly against the corner surface of the housing. The front channel elements 52 and 53 can then be slid into place on their respective dovetails. Of course, it will be obvious that the particular sequence may be varied. For example, the front channel elements 52 and 53 may be placed on first, or one of the side channel elements 46 or 47 can be placed on before the rear channel element 51. Further, the particular number of channel elements, or their shape, size, form or placement may be varied to meet the structural and aesthetic requirements of a particular system. Generally, however the structure should provide a method of quickly and easily attaching the upper and lower elements together in a secure manner so as to allow for the transfer of a portion of the load from the lower element 13 to the upper element 12. It should also preferably be aesthetically pleasing and cover any gaps or misalignments that may exist between the upper and lower elements. Finally, it should allow for a quick and easy disassembly for repair and/or maintenance services.

What is claimed is:

1. A housing for an air conditioning unit of the type having an outdoor section and an indoor section comprising:

an upper portion having a top wall and downwardly extending side walls that define an upper rim at their lower edges, with at least two oppositely disposed of said side walls having a flange extending outwardly and upwardly from said upper rim;

a lower portion having a bottom wall and upwardly extending side walls that define a lower rim at their upper edges, with at least two oppositely disposed of said side walls having a flange extending outwardly and downwardly from said lower rim;

said upper and lower rims being of generally the same size such that when said rims are mated together in vertical juxtaposition, said lower rim flange and said upper rim flange form a dovetail; and channel means slideably engageable over said dovetails for securing the upper and lower portions.

2. A housing as set forth in claim 1 wherein said two oppositely disposed side walls extend across both the outdoor section and the indoor section.

3. A housing as set forth in claim 1 wherein a said upper portion includes a third side wall having a flange extending outwardly and upwardly from said upper rim;

said lower portion includes a third side wall having a flange extending outwardly and downwardly from said lower rim; and said channel means includes a channel member slideably engageable over the dovetail formed by the combination of said third side wall flanges.

4. A housing as set forth in claim 1 wherein said sidewalls include arcuate corner portions and further wherein said channel means include arcuate portions which conform with said arcuate corner portions when said channel means are slideably installed.

5. A housing structure for containing an air conditioning system of the type having an outdoor section and an indoor section comprising:

a lower shell element having a bottom wall and side walls extending upwardly therefrom to a lower rim, said lower rim having on at least two opposing sides thereof, a flange which extends outwardly and downwardly;

an upper shell element having a top wall and side walls extending downwardly therefrom to an upper rim, said upper rim having on at least two opposing sides thereof, a flange which extends outwardly and upwardly;

said lower and upper rims being of substantially the same size such that when they are placed in vertically abutting relationship, their respective flanges form a dovetail on each of said at least two opposing sides; and channel means placed over each of said dovetails, in conforming relationship therewith, to secure said upper and lower shelves together.

6. A housing structure as set forth in claim 5 wherein said lower and upper shelves are formed of a polymeric material.

7. A housing structure as set forth in claim 5 wherein said channel means is formed of an aluminum extruded material.

8. An improved method of assembly for a room air conditioning housing comprising the steps of:

providing a lower housing element having a bottom wall and side walls extending upwardly on at least two sides to form a lower rim, said lower rim having an outwardly and downwardly extending flange formed thereon;

providing an upper housing element having a top wall and side walls extending downwardly on at least two sides to form an upper rim, said upper rim having an outwardly and upwardly extending flange formed thereon;

placing said upper housing element over said lower housing element with said upper and lower rims in abutting relationship, such that their respective flanges together form a dovetail structure on each of said at two sides; and sliding a mating channel member over each of said dovetail structures to secure said upper and lower housing elements together.

* * * * *